US005207970A

United States Patent [19]

Joseph et al.

[11] Patent Number: 5,207,970

[45] Date of Patent: May 4, 1993

[54] METHOD OF FORMING A WEB OF MELT BLOWN LAYERED FIBERS

[75] Inventors: Eugene G. Joseph, Arden Hills; Daniel E. Meyer, Stillwater, both of Minn.

[73] Assignee: Minnesota Mining and Manufacturing Company, St. Paul, Minn.

[21] Appl. No.: 769,206

[22] Filed: Sep. 30, 1991

[51] Int. Cl.[5] ..... D01D 5/08

[52] U.S. Cl. ..... 264/518; 264/555; 264/174; 264/211.14

[58] Field of Search ..... 264/518, 555, 556, 171, 264/174, 211.14

[56] References Cited

U.S. PATENT DOCUMENTS

| | | | |
|---|---|---|---|
| 3,480,502 | 11/1969 | Schrenk | 156/270 |
| 3,487,505 | 1/1970 | Chisholm et al. . | |
| 3,557,265 | 1/1971 | Chisholm et al. | 264/47 |
| 3,672,802 | 6/1972 | Matsui et al. | 425/131 |
| 3,681,189 | 8/1972 | Matsui et al. | 161/175 |
| 3,687,589 | 8/1972 | Schrenk | 425/109 |
| 3,759,647 | 9/1973 | Schrenk et al. | 425/131 |
| 3,825,379 | 7/1974 | Lohkamp et al. | 425/72 |
| 3,841,953 | 10/1974 | Lohkamp et al. | 161/150 |
| 3,849,241 | 11/1974 | Butin et al. | 161/169 |
| 4,103,058 | 7/1978 | Humlicek | 428/171 |
| 4,117,194 | 9/1978 | Barbe et al. | 428/374 |
| 4,118,531 | 10/1978 | Hauser | 428/224 |
| 4,197,069 | 4/1980 | Cloeren | 425/131.1 |
| 4,295,809 | 10/1981 | Mikami et al. | 425/72 |
| 4,375,718 | 3/1983 | Wadsworth et al. | 29/592 |
| 4,381,274 | 4/1983 | Kessler et al. | 264/147 |
| 4,429,001 | 1/1984 | Kolpin et al. | 428/283 |
| 4,460,649 | 7/1984 | Park et al. | 428/373 |
| 4,557,972 | 12/1985 | Okamoto et al. | 428/373 |
| 4,627,950 | 12/1986 | Matsui et al. | 264/103 |
| 4,657,802 | 4/1987 | Morman | 428/152 |
| 4,729,371 | 3/1988 | Krueger et al. | 128/206.19 |
| 4,755,178 | 7/1988 | Insley et al. | 604/367 |
| 4,818,463 | 4/1989 | Buehning | 264/40.1 |
| 4,939,008 | 7/1990 | Komaki | 428/34.3 |
| 4,986,743 | 1/1991 | Buehning | 425/7 |
| 4,988,560 | 1/1991 | Meyer et al. | 428/297 |

OTHER PUBLICATIONS

Wente, Van A., "Superfine Thermoplastic Fibers", *Industrial Engineering Chemistry,* vol. 48, pp. 1342–1346.

Wente, Van A. et al., "Manufacture of Superfine Organic Fibers", Report No. 4364 of the Naval Research Laboratories, published May 25, 1954.

*Primary Examiner*—Jill L. Heitbrink

*Attorney, Agent, or Firm*—Gary L. Griswold; Roger R. Tamte; William J. Bond

[57] ABSTRACT

A method for forming melt-blown fiber webs which webs have multiple layers of polymeric material. The method provides novel webs and control over web properties.

5 Claims, 3 Drawing Sheets

METHOD OF FORMING A WEB OF MELT BLOWN LAYERED FIBERS

FIELD OF THE INVENTION

The invention relates to a method of producing novel melt-blown nonwoven webs useful in a variety of applications. The method includes producing melt-blown microfibers comprised of longitudinally distinct polymeric layers.

BACKGROUND OF THE INVENTION

It has been proposed in U.S. Pat. No. 3,841,953 to form nonwoven webs of melt-blown fibers using polymer blends, in order to obtain webs having novel properties. A problem with these webs, however, is that the polymer interfaces causes weaknesses in the individual fibers that causes severe fiber breakage and weak points. The web tensile properties reported in this patent are generally inferior to those of webs made of corresponding single polymer fibers. This web weakness is likely due to weak points in the web from incompatible polymer blends and the extremely short fibers in the web.

A method for producing bicomponent fibers in a melt-blown process is disclosed in U.S. Pat. No. 4,729,371. The polymeric materials are fed from two conduits which meet at a 180 degree angle. The polymer flowstreams then converge and exit via a third conduit at a 90 degree angle to the two feed conduits. The two feedstreams form a layered flowstream in this third conduit, which bilayered flowstream is fed to a row of side-by-side orifices in a melt-blowing die. The bi-layered polymer melt streams extruded from the orifices are then formed into microfibers by a high air velocity attenuation or a "melt-blown" process. The product formed is used specifically to form a web useful for molding into a filter material. The process disclosed concerns forming two-layer microfibers. Further, the process has no ability to produce webs where web properties are adjusted by fine control over the fiber layering arrangements and/or the number of layers.

U.S. Pat. No. 4,557,972 discloses a sheath-core composite fiber of an allegedly ultrafine denier (less than 0.5 denier) The fibers are formed from a special spinneret for forming large, three-component fibers, with two of the components forming ultrafine included material in a matrix of the third component. Ultrafine fibers are then obtained by selectively removing the matrix (the "sea") material, leaving the included material as fine fibers. This process is complex and cannot practically be used to form non-woven webs. Similar processes are proposed by U.S. Pat. Nos. 4,460,649, 4,627,950 and 4,381,274, which discuss various "islands-in-a-sea" processes for forming multi-component yarns. U.S. Pat. No. 4,117,194 describes a bi-component textile spun fiber with improved crimp properties.

U.S. Pat. Nos. 3,672,802 and 3,681,189 describe spun fibers allegedly having a large number of layers each of a separate polymer component. The two polymers are fed into a specially designed manifold that repeatedly combines, splits and re-combines a polymer stream(s) to form a somewhat stratified stream of the two distinct polymers. The process disclosed in these two patents is similar to mixing the polymers due to the significant amount of non-linear polymer flow introduced during the repeated splitting and re-combining of the polymer stream(s). However, the splitting and re-combining is done in line with the polymer flow, and the resulting fibers apparently have distinct longitudinal regions of one or the other polymer rather than the substantially non-directional arrangement of separate polymer regions one would obtain with incomplete batch mixing. However, the polymer layers in the fibers are very indistinct and irregular. Further, due to the excessively long contact period between the polymers, it would be difficult to handle polymers with significantly different melt viscosities by this process The fibers produced are textile size, and the layering effect is done to improve certain properties over homogeneous fibers (not webs) such as dyeability properties, electrification properties, hydrophilic properties or tensile properties.

SUMMARY OF THE INVENTION

The present invention is directed to a process for producing a non-woven web of longitudinally layered melt-blown microfibers. The microfibers are produced by a process comprising first feeding separate polymer melt streams to a manifold means, optionally separating at least one of the polymer melt streams into at least two distinct streams, and combining all the melt streams, including the separated streams, into a single polymer melt stream of longitudinally distinct layers, preferably of two different polymeric materials arrayed in an alternating manner. The combined melt stream is then extruded through fine orifices and formed into a web of melt-blown microfibers.

DESCRIPTION OF THE PREFERRED EMBODIMENTS

Figure 1:
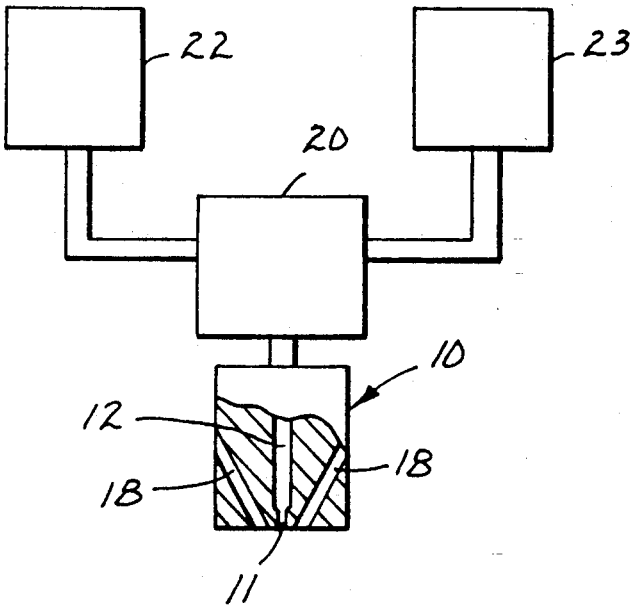
FIG. 1 is a schematic view of an apparatus useful in the practice of the invention method.

The microfibers produced by the invention process are prepared, in part, using the apparatus discussed, for example, in Wente, Van A., "Superfine Thermoplastic Fibers," *Industrial Engineering Chemistry,* Vol. 48, pp 1342–1346 and in Wente, Van A. et al., "Manufacture of Superfine Organic Fibers," Report No. 4364 of the Naval Research Laboratories, published May 25, 1954, and U.S. Pat. Nos. 3,849,241 (Butin et al.), 3,825,379 (Lohkamp et al.), 4,818,463 (Buehning), 4,986,743 (Buehning), 4,295,809 (Mikami et al.) or 4,375,718 (Wadsworth et al.). These apparatuses and methods are useful in the invention process in the portion shown as die 10 in FIG. 1, which could be of any of these conventional designs.

The polymeric components are introduced into the die cavity 12 of die 10 from a separate splitter, splitter region or combining manifold 20, and into the, e.g., splitter from extruders, such as 22 and 23. Gear pumps and/or purgeblocks can also be used to finely control the polymer flow rate. In the splitter or combining manifold, the separate polymeric component flowstreams are formed into a single layered flowstream. However, preferably, the separate flowstreams are kept out of direct contact for as long a period as possible prior to reaching the die 10. The separate polymeric flowstreams from the extruder(s) can be also split in the splitter (20). The split or separate flowstreams are combined only immediately prior to reaching the die, or die orifices. This minimizes the possibility of flow instabilities generating in the separate flowstreams after being combined in the single layered flowstream, which tends to result in non-uniform and discontinuous longitudinal layers in the multi-layered microfibers. Flow instabilities can also have adverse effects on non-woven web properties such as strength, temperature stability, or other desirable properties obtainable with the invention process.

The separate flowstreams are also preferably established into laminar flowstreams along closely parallel flowpaths. The flowstreams are then preferably combined so that at the point of combination, the individual flows are laminar, and the flowpaths are substantially parallel to each other and the flowpath of the resultant combined layered flowstream. This again minimizes turbulence and lateral flow instabilities of the separate flowstreams in and after the combining process.

It has been found that a suitable splitter 20, for the above-described step of combining separate flowstreams, is one such as is disclosed, for example, in U.S. Pat. No. 3,557,265, which describes a manifold that forms two or three polymeric components into a multi-layered rectilinear melt flow. The polymer flowstreams from separate extruders are fed into plenums then to one of the three available series of ports or orifices. Each series of ports is in fluid communication with one of the plenums Each stream is thus split into a plurality of separated flowstreams by one of the series of ports, each with a height-to-width ratio of from about 0.01 to 1. The separated flowstreams, from each of the three plenum chambers, are then simultaneously coextruded by the three series of parts into a single channel in an interlacing manner to provide a multi-layered flowstream. The combined, multi-layered flowstream in the channel is then transformed (e.g., in a coathangar transition piece), so that each layer extruded from the manifold orifices has a substantially smaller height-to-width ratio to provide a layered combined flowstream at the die orifices with an overall height of about 50 mils or less, preferably 15–30 mils or less. The width of the flowstream can be varied depending on the width of the die and number of die orifices arranged in a side-by-side array. Other suitable devices for providing a multi-layer flowstream are such as disclosed in U.S. Pat. Nos. 3,924,990 (Schrenk); 3,687,589 (Schrenk); 3,759,647 (Schrenk et al.) or 4,197,069 (Cloeren), all of which, except Cloeren, disclose manifolds for bringing together diverse polymeric flowstreams into a single, multi-layer flowstream that is ordinarily sent through a coathanger transition piece or neck-down zone prior to the film die outlet. The Cloeren arrangement has separate flow channels in the die cavity. Each flow channel is provided with a back-pressure cavity and a flow-restriction cavity, in successive order, each preferably defined by an adjustable vane. The adjustable vane arrangement permits minute adjustments of the relative layer thicknesses in the combined multi-layered flowstream. The multi-layer polymer flowstream from this arrangement need not necessarily be transformed to the appropriate length/width ratio, as this can be done by the vanes, and the combined flowstream can be fed directly into the die cavity 12.

From the die cavity 12, the multi-layer polymer flowstream is extruded through an array of side-by-side orifices 11. As discussed above, prior to this extrusion, the feed can be formed into the appropriate profile in the cavity 12, suitably by use of a conventional coathanger transition piece. Air slots 18, or the like, are disposed on either side of the row of orifices 11 for directing uniform heated air at high velocity at the extruded layered melt streams. The air temperature is generally about that of the meltstream, although preferably 20°–30° C. higher than the polymer melt temperature. This hot, high-velocity air draws out and attenuates the extruded polymeric material, which will generally solidify after traveling a relatively short distance from the die 10. The solidified or partially solidified fibers are then formed into a web by known methods and collected (not shown). The collecting surface can be a solid or perforated surface in the form of a flat surface or a drum, a moving belt, or the like. If a perforated surface is used, the backside of the collecting surface can be exposed to a vacuum or low-pressure region to assist in the deposition of fibers, such as is disclosed in U.S. Pat. No. 4,103,058 (Humlicek). This low-pressure region allows one to form webs with pillowed low-density regions. The collector distance can generally be from 3 to 50 inches from the die face With closer placement of the collector, the fibers are collected when they have more velocity and are more likely to have residual tackiness from incomplete cooling. This is particularly true for inherently more tacky thermoplastic materials, such as thermoplastic elastomeric materials. Moving the collector closer to the die face, e.g., preferably 3 to 12 inches, will result in stronger inter-fiber bonding and a less lofty web. Moving the collector back will generally tend to yield a loftier and less coherent web.

The temperature of the polymers in the splitter region is generally about the temperature of the higher melting point component as it exits its extruder. This splitter region or manifold is typically integral with the die and is kept at the same temperature. The temperature of the separate polymer flowstreams can also be controlled to bring the polymers closer to a more suitable relative viscosity. When the separate polymer flowstreams converge, they should generally have an apparent viscosity of from 150 to 800 poise, preferably from 200 to 400 poise, (as measured by a capillary rheometer). The relative viscosities of the separate polymeric flowstreams to be converged should generally be fairly well matched. Empirically, this can be determined by varying the temperature of the melt and observing the crossweb properties of the collected web. The more uniform the crossweb properties, the better the viscosity match. The overall viscosity of the layered combined polymeric flowstream(s) at the die face should be from 150 to 800 poise, preferably from 200 to 400 poise. The differences in relative viscosities are preferably generally the same as when the separate polymeric flowstreams are first combined. The apparent viscosities of the polymeric flowstream(s) can be adjusted at this point by varying the temperatures as per U.S. Pat. No. 3,849,241.

The size of the polymeric fibers formed depends to a large extent on the velocity and temperature of the attenuating airstream, the orifice diameter, the temperature of the melt stream, and the overall flow rate per orifice. At high air volume rates, the fibers formed have an average fiber diameter of less than about 10 micrometers, however, there is an increased difficulty in obtaining webs having uniform properties as the air flow rate increases. At more moderate air flow rates, the polymers have larger average diameters, however, with an increasing tendency for the fibers to entwine into formations called "ropes". This is dependent on the polymer flow rates, of course, with polymer flow rates in the range of 0.05 to 0.5 gm/min/orifice generally being suitable. Coarser fibers, e.g., up to 25 micrometers or more, can be used in certain circumstances such as large pore, or coarse, filter webs.

The multi-layer microfibers of the invention process can be admixed with other fibers or particulates prior to being collected. For example, sorbent particulate matter or fibers can be incorporated into the coherent web of blown multi-layered fibers as discussed in U.S. Pat. Nos. 3,971,373 or 4,429,001. In these patents, two separate streams of melt-blown fibers are established with the streams intersecting prior to collection of the fibers. The particulates, or fibers, are entrained into an airstream, and this particulate-laden airstream is then directed at the intersection point of the two microfiber streams. Other methods of incorporating particulates or fibers, such as staple fibers, bulking fibers or binding fibers, can be used with the invention method of forming melt-blown microfiber webs, such as is disclosed, for example, in U.S. Pat. Nos. 4,118,531, 4,429,001 or 4,755,178, where particles or fibers are delivered into a single stream of melt-blown fibers.

Other materials such as surfactants or binders can be incorporated into the web before, during or after its collection, such as by use of a spray jet. If applied before collection, the material is sprayed on the stream of microfibers, with or without added fibers or particles, traveling to the collection surface.

The process of the invention provides webs having unique, and generally superior, properties and characteristics when compared to webs formed from a homogeneous polymer melt, of a single polymer or blends of polymers (compatible or incompatible). As long as the viscosities of the particular polymers are suitably matched, it is possible to form generally uniform multilayered microfibers from two (or more) polymers which otherwise may be incompatible. It is thus possible to obtain microfiber nonwoven webs having properties reflective of these otherwise incompatible polymers (or blends) without the problems with blends, as noted in U.S. Pat. No. 3,841,953. However, the overall web properties of these novel multi-layered microfiber webs are generally unlike the web properties of homogeneous webs formed of any of the component materials. In fact, the multi-layered microfibers frequently provide completely novel web properties and/or ranges of properties not obtainable with any of the component polymer materials. For example, fiber and web strength can be controlled within wide ranges for given combinations of polymers by varying, independently, the relative ratios of the polymers, the layer order in the microfibers, the number of layers, the collector distance and other process variables. The invention process thus allows precise control of web strength by varying one or all of these variables.

The invention method of producing multiple-layer, melt-blown fibers and webs allows overall web properties to be specifically modified for particular applications by intimately combining known polymers as discrete continuous layers in individual microfibers to produce non-woven webs with novel properties. Further, the novel web properties can be adjusted by varying the relative arrangement and relative thickness of a given set of layers. This will adjust the relative amount of each polymeric material available for surface property interactions. For example, for an odd number of layers, with three as the minimum, the outside layers can advantageously comprise 1 to 99 volume percent of the total fiber volume. At the low end of this volume range, the outside layers will still contribute significantly to the surface properties of the fibers forming the web without significantly modifying the bulk fiber properties, such as tensile strength and modulus behavior. In this manner, polymers with desirable bulk properties, such as tensile strength, can be combined with polymers having desirable surface properties, such as good bondability, in individual microfibers of a melt-blown web to provide melt-blown webs with a high relative proportion of the desirable properties from each polymer. At higher percentages, the outer layers will still contribute disproportionately to fiber surface properties, but will contribute more to the fiber bulk properties potentially providing webs of novel properties.

Where there is an even number of layers, the polymers forming the layered melt-blown fibers will have an increased tendency to contribute proportionately to both the bulk and surface properties. The relative volume amount of each polymeric component is preferably within a more equal volume percent range, for example, each ranging from about 40 to 60 volume percent for two components as neither polymer can easily disproportionately contribute to the microfiber surface or bulk properties. However, the relative volume percent in the even-layer number embodiments can range as broadly as is described for the odd-layer number embodiments. The above discussions with regard to odd and even numbers of layers assumes alternating layers and a simple two-component system. Various modifications to the above could be made by the use of more than two different types of layers (e.g., with different compositions) or by providing non-alternating layers.

With the invention process, the web properties can further be altered by variations in the number of layers employed at a given relative volume percent and layer arrangement. As described above, variation in the number of layers, at least at a low number of layers, has a tendency to significantly vary the relative proportion of each polymer (assuming two polymeric materials) at the microfiber surface. This (assuming alternating layers of two polymeric materials) translates into variation of those web properties to which the microfiber surface properties significantly contribute. Thus, web properties can change depending on what polymer or composition comprises the outside layer(s). However, as the number of layers increases, this variation in web properties based on surface area effects diminishes. At higher-layer numbers, the relative thicknesses of the individual fiber layers will tend to decrease, significantly decreasing the surface area effect of any individual layer. For the preferred melt-blown microfibers with average diameters of less than 10 micrometers, the individual fiber layer thicknesses can get well below 1 micrometer.

Additional effects on the fiber and web properties can be attributed to the modulation of the number of fiber layers alone. Specifically, it has been found that fiber and web modulus increases with increases in the number of individual layers. Although not wishing to be bound by theory, it is believed that the decrease in individual layer thicknesses in the microfiber has a significant effect on the crystalline structure and behavior of the component polymers. For example, spherulitic growth could be constrained by adjacent layers resulting in more fine-grained structures. Further, the interfacial layer boundaries may constrain transverse polymer flow in the orifice increasing the relative percent of axial flow, tending to increase the degree of order of the polymers in the layered form and hence could influence crystallization in this manner. These factors can likely influence the macro scale behavior of the component fibers in the web and hence web behavior itself.

Further, with increased microfiber layering, the number of interfaces, and interfacial area, between adjacent layers, increases significantly. This could tend to increase fiber stiffness and strength due to increased reinforcement and constrainment of the individual layers and transcrystallization. It has been found that it becomes increasingly difficult to separate the fiber inner layers as the total number of layers in the fibers increase. This is true even for relatively incompatible polymers that would ordinarily require compatibilizers or bonding layers to prevent layer separation.

The above factors can be used in the invention process to provide melt-blown, nonwoven webs having properties designed for specific applications. For example, web modulus for a given combination of polymers can be adjusted up or down by placing particular layers on the inside or outside, increasing or decreasing the total number of layers, adjusting the relative thickness of an individual layer or layers, and/or altering the relative volume percent of the component layer polymers. Using the above variables, the invention process can readily provide a melt-blown web with a given tensile strength, or other tensile property, with a given combination of materials within a broad range of, e.g., tensile strengths.

The number of layers obtainable with the invention process is theoretically unlimited. Practically, the manufacture of a manifold, or the like, capable of splitting and/or combining multiple polymer streams into a very highly layered arrangement would be prohibitively complicated and expensive. Additionally, in order to obtain a flowstream of suitable dimensions for feeding to the die orifices, forming and then maintaining layering through a suitable transition piece can become difficult. A practical limit of 1,000 layers is contemplated, at which point the processing problems would likely outweigh any potential added property benefits.

The webs formed can be of any suitable thickness for the desired end use. However, generally a thickness from 0.01 to 5 centimeters is suitable for most applications. Further, for some applications, the web can be a layer in a composite multi-layer structure. The other layers can be supporting webs, films (such as elastic films, semi-permeable films or impermeable films). Other layers could be used for purposes such as absorbency, surface texture, rigidification and can be nonwoven webs formed of, for example, staple spunbond and/or melt-blown fibers. The other layers can be attached to the invention melt-blown web by conventional techniques such as heat bonding, binders or adhesives or mechanical engagement, such as hydroentanglement or needle punching. Other structures could also be included in a composite structure, such as reinforcing or elastic threads or strands, which would preferably be sandwiched between two layers of the composite structures. These strands or threads can likewise be attached by the conventional methods described above.

Webs, or composite structures including webs of the invention can be further processed after collection or assembly such as by calendaring or point embossing to increase web strength, provide a patterned surface, and fuse fibers at contact points in a web structure or the like; orientation to provide increased web strength; needle punching; heat or molding operations; coating, such as with adhesives to provide a tape structure; or the like.

The fiber-forming materials useful in forming the multi-layered microfiber, melt-blown webs are fiber-forming thermoplastic materials or blends having suitable viscosities for melt-blowing operations. Exemplary polymeric materials include polyesters, such as polyethylene terephthalate; polyalkylenes, such as polyethylene or polypropylene; polyamides, such as nylon 6; polystyrenes; polyarylsulfones; or elastomeric thermoplastics: such as polyurethanes (e.g., "Morthane TM", available from Morton Thiokol Corp.) A-B block copolymers where A is formed of poly(vinyl arene) moieties such as polystyrene, and B is an elastomeric midblock such as a conjugated diene or a lower alkene in the form of a linear di- or tri-block copolymer, a star, radial or branched copolymer, such as elastomers sold as "KRATON TM" (Shell Chemical Co.); polyetheresters (such as "Arnitel TM" available from Akzo Plastics Co.); or polyamides (such as "Pebax TM" available from Autochem Co.). Copolymers and blends can also be used. For example, A-B block copolymer blends as described in U.S. Pat. No. 4,657,802 are suitable where such block copolymers are preferably blended with polyalkylenes. The various melt-blowable polymers, copolymers and blends could be combined to provide a suitable matching of viscosities as discussed above. Although the invention method can be used to form heat-moldable webs such as disclosed in U.S. Pat. No. 4,729,371, the control over the web properties renders the invention process suitable for forming customized melt-blown webs for a wide variety of purposes.

The following examples are provided to illustrate presently contemplated preferred embodiments and the best mode for practicing the invention, but are not intended to be limiting thereof.

TEST PROCEDURES

Tensile Modulus

Tensile modulus data on the multi-layer BMF webs was obtained using an Instron Tensile Tester (Model 1122) with a 10.48 cm (2 in.) jaw gap and a crosshead speed of 25.4 cm/min. (10 in./min.). Web samples were 2.54 cm (1 in.) in width. Elastic recovery behavior of the webs was determined by stretching the sample to a predetermined elongation and measuring the length of the sample after release of the elongation force and allowing the sample to relax for a period of 1 minute.

Thermal Properties

Melting and crystallization behavior of the polymeric components in the multi-layered BMF webs were studied using a Perkin-Elmer Model DSC-7 Differential Scanning Calorimeter equipped with a System 4 analyzer. Heating scans were carried out at 10° or 20° C. per minute with a holding time of three (3) minutes above the melting temperature followed by cooling at a rate of 10° C. per minute. Areas under the melting endotherm and the crystallization exotherm provided an indication of the amount of crystallinity in the polymeric components of the multi-layered BMF webs.

Wide Angle X-Ray Scattering Test

X-Ray diffraction data were collected using a Philips APD-3600 diffractometer (fitted with a Paur HTK temperature controller and hot stage). Copper Koc radiation was employed with power tube settings of 45 kV and 4 mA and with intensity measurements made by means of a Scintillation detector. Scans within the 2–50 degree (2Θ) scattering region were performed for each sample at 25 degrees C. and a 0.02 degree step increment and 2 second counting time.

EXAMPLE 1

A polypropylene/polyurethane multi-layer BMF web of the present invention was prepared using a melt-blowing process similar to that described, for example, in Wente, Van A., "Superfine Thermoplastic Fibers," in *Industrial Engineering Chemistry,* Vol. 48, pages 1342 et seq (1956), or in Report No. 4364 of the Naval Research Laboratories, published May 25, 1954, entitled "Manufacture of Superfine Organic Fibers" by Wente, Van A.; Boone, C.D.; and Fluharty, E.L., except that the BMF apparatus utilized two extruders, each of which was equipped with a gear pump to control the polymer melt flow, each pump feeding a five-layer feedblock (splitter) assembly similar to that described in U.S. Pat. Nos. 3,480,502 (Chisholm et al.) and 3,487,505 (Schrenk) which was connected to a melt-blowing die having circular smooth surfaced orifices (10/cm) with a 5:1 length to diameter ratio. The first extruder (260° C.) delivered a melt stream of a 800 melt flow rate (MFR) polypropylene (PP) resin (PP 3495G, available from Exxon Chemical Corp.), to the feedblock assembly which was heated to about 260° C. The second extruder, which was maintained at about 220° C., delivered a melt stream of a poly(esterurethane) (PU) resin (Morthane TM PS 455-200, available from Morton Thiokol Corp.) to the feedblock. The feedblock split the two melt streams. The polymer melt streams were merged in an alternating fashion into a five-layer melt stream on exiting the feedblock, with the outer layers being the PP resin. The gear pumps were adjusted so that a 75:25 pump ratio PP:PU polymer melt was delivered to the feedblock assembly and a 0.14 kg/hr/cm die width (0.8 lb/hr/in.) polymer throughout rate was maintained at the BMF die (260° C.). The primary air temperature was maintained at approximately 220° C. and at a pressure of suitable to produce a uniform web with a 0.076 cm gap width. Webs were collected at a collector to BMF die distance of 30.5 cm (12 in.). The resulting BMF web, comprising five-layer microfibers having an average diameter of less than about 10 micrometers, had a basis weight of 50 g/m$^2$.

EXAMPLE 2

A BMF web having a basis weight of 50 g/m$^2$ and comprising five-layer microfibers having an average diameter of less than about 10 micrometers was prepared according to the procedure of Example 1, except that the PP and PU melt streams were delivered to the five-layer feedblock in a 50:50 ratio.

EXAMPLE 3

A BMF web having a basis weight of 50 g/m$^2$ and comprising five-layer microfibers having an average diameter of less than about 10 micrometers was prepared according to the procedure of Example 1, except that the PP and PU melt streams were delivered to the five-layer feedblock in a 25:75 ratio.

CONTROL WEB I

A control web of the 800 MFR polypropylene resin was prepared according to the procedure of Example 1, except that only one extruder, which was maintained at 260° C., was used, and it was connected directly to the BMF die through a gear pump. The die and air temperatures were maintained at 260° C. The resulting BMF web had a basis weight of 50 g/m$^2$ and an average fiber diameter of less than about 10 micrometers.

CONTROL WEB II

A control web of the polyurethane resin (Morthane TM PS455-200) was prepared according to the procedure of Example 1, except that only one extruder, which was maintained at 220° C., was used which was connected directly to the BMF die through a gear pump. The die and air temperatures were maintained at 220° C. The resulting BMF web had a basis weight of 50 g/m$^2$ and an average fiber diameter of less than about 10 micrometers.

Table 1 summarizes the tensile modulus values for BMF webs comprising five-layer microfibers of varying PP/PU polymer ratios.

TABLE 1

Tensile Modulus
Five-Layer PP/PU BMF Webs
50 g/m$^2$ Basis Weight

| Example | Pump Ratio PP/PU | Tensile Modulus MD (kPa) | Tensile Modulus XMD (kPa) |
|---|---|---|---|
| Control I | 100:0 | 2041 | 2897 |
| 1 | 75:25 | 6821 | 9235 |
| 2 | 50:50 | 8083 | 9490 |
| 3 | 25:75 | 8552 | 12214 |
| Control II | 0:100 | 1055 | 1814 |

EXAMPLE 4

A BMF web having a basis weight of 100 g/m$^2$ and comprising two-layer microfibers having an average diameter of less than about 10 micrometers was prepared according to the procedure of Example 3, except that the PP and PU melt streams were delivered to a two-layer feedblock, and the die and air temperatures were maintained at about 230° C.

EXAMPLE 5

A BMF web having a basis weight of 100 g/m$^2$ and comprising three-layer microfibers having an average diameter of less than about 10 micrometers was prepared according to the procedure of Example 3, except that the PP and PU melt streams were delivered to a three-layer feedblock.

EXAMPLE 6

A BMF web having a basis weight of 100 g/m$^2$ and comprising five-layer microfibers having an average diameter of less than about I0 micrometers was prepared according to the procedure of Example 3. Example 3 is a five-layer construction.

EXAMPLE 7

A BMF web having a basis weight of 100 g/m$^2$ and comprising twenty-seven-layer microfibers having an average diameter of less than about 10 micrometers was prepared according to the procedure of Example 3, except that the PP and PU melt streams were delivered to a twenty-seven-layer feedblock.

Table 2 summarizes the modulus values for a series of BMF webs having a 25:75 PP/PU Pump Ratio, but varying numbers of layers in the microfibers.

TABLE 2

Web Modulus as a Function of Layers in Microfiber
25:75 PP/PU Pump Ratio
100 g/m$^2$ Basis Weight

| Example | Number of Layers | MD Tensile Modulus (kPa) |
|---|---|---|
| 4 | 2 | 10835 |
| 5 | 3 | 11048 |
| 6 | 5 | 15014 |
| 7 | 27 | 17097 |

Figure 2:
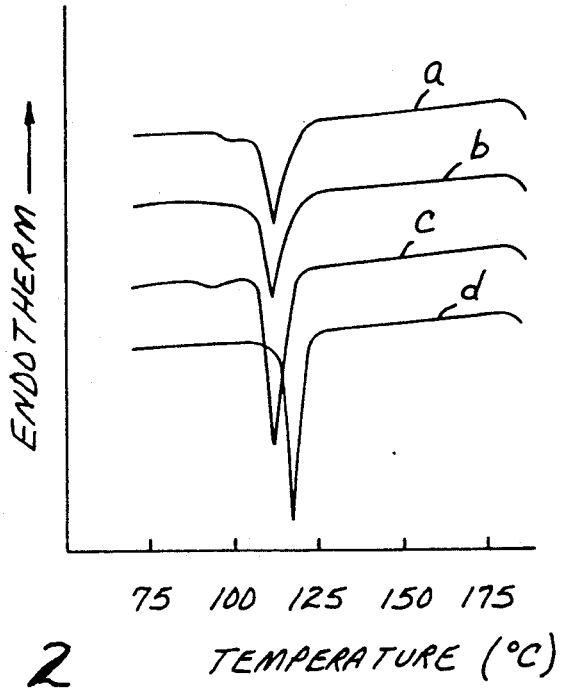
FIG. 2 is a plot of differential scanning calorimetry scans for Examples 4–7 showing increasing exotherms with increasing layering.
Figure 3:
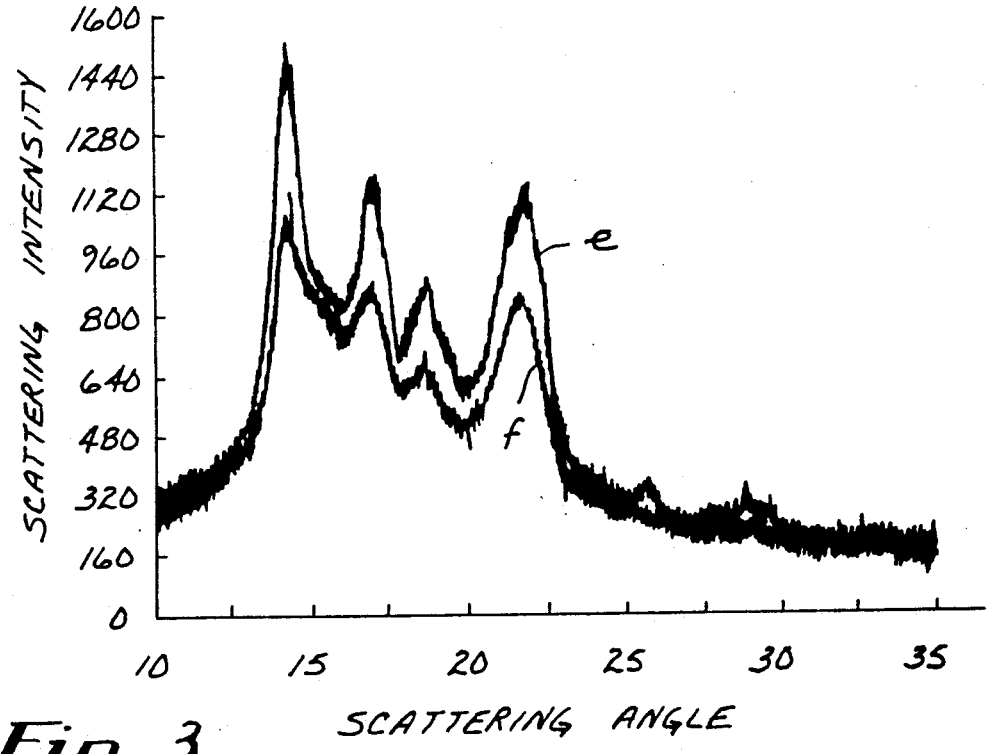
FIG. 3 is a plot of wide-angle x-ray scattering for Examples 5 and 7 showing increasing crystallinity with increasing layering.

The effect that the number of layers within the microfiber cross-section had on the crystallization behavior of the PP/PU BMF webs was studied using differential scanning calorimetry the results of which are graphically presented in FIG. 2. An examination of the crystallization exotherms for the BMF webs of Examples 4, 5, 6 and 7 (a, b, c and d respectively), which corresponds to blown microfibers having 2, 3, 5 and 27 layers, respectively, indicates that the peak of the crystallization exotherm for the web of Example 7 is approximately 6° C. higher than the corresponding peak values for webs comprising blown microfibers having fewer layers. This data suggests that the crystallization process is enhanced in the microfibers having 27 layers, which is further supported by the examination of the wide angle X-ray scattering data that is illustrated in FIG. 3 and confirms higher crystallinity in the PP of the 27 layer microfiber web samples (e corresponds to Example 7 and f corresponds to Example 5 after washing out the PU with tetrahydrofuran).

EXAMPLE 8

A BMF web having a basis weight of 100 g/m$^2$ and comprising two-layer microfibers having an average diameter of less than about 10 micrometers was prepared according to the procedure of Example 1, except that a 105 MI low-density polyethylene (LLDPE, Aspun TM 6806 available from Dow Chemical) was substituted for the polypropylene and a poly(esterurethane) (PU) resin (Morthane TM PS 440-200, available from Morton Thiokol Corp.) was substituted for the Morthane TM PS 455-200, the extruder temperatures were maintained at 230° C. and 230° C., respectively, the melt streams were delivered to a two-layer feedblock maintained at 230° C. at a 75:25 ratio, the BMF die and primary air supply temperatures were maintained at 225° C. and 215° C., respectively, and the collector distance was 30.5 cm.

EXAMPLE 9

A BMF web having a basis weight of 100 g/m$^2$ and comprising two-layer microfibers having an average diameter of less than about 10 micrometers was prepared according to the procedure of Example 8, except that the PE and PU melt streams were delivered to the two-layer feedblock in a 50:50 ratio.

EXAMPLE 10

A BMF web having a basis weight of I00 g/m$^2$ and comprising two-layer microfibers having an average diameter of less than about 10 micrometers was prepared according to the procedure of Example 8, except that the PE and PU melt streams were delivered to the two-layer feedblock in a 25:75 ratio.

CONTROL WEB III

A control web of the LLDPE resin (Aspun TM 6806) was prepared according to the procedure of Example 1, except that only one extruder, which was maintained at 210° C., was used, and it was connected directly to the BMF die through a gear pump, and the die and air temperatures were maintained at 210° C., and the collector distance was 25.4 cm. The resulting BMF web had a basis weight of 100 g/m$^2$ and an average fiber diameter of less than about 10 micrometers.

CONTROL WEB IV

A control web of the polyurethane resin (Morthane TM PS440-200) was prepared according to the procedure of Example 1, except that only one extruder, which was maintained at 230° C., was used which was connected directly to the BMF die through a gear pump, and the die and air temperatures were maintained at 230° C. The resulting BMF web had a basis weight of 100 g/m$^2$ and an average fiber diameter of less than about 10 micrometers.

Table 3 summarizes the tensile modulus values for BMF webs comprising two-layer microfibers of varying PE/PU compositions.

TABLE 3

Tensile Modulus
Two-Layer PE/PU BMF Webs
100 g/m$^2$ Basis Weight

| Example | Pump Ratio PE/PU | MD Tensile Modulus (kPa) |
|---|---|---|
| Control III | 100:0 | 1172 |
| 8 | 75:25 | 4923 |
| 9 | 50:50 | 3737 |
| 10 | 25:75 | 2654 |
| Control IV | 0:100 | 2130 |

EXAMPLE 11

A BMF web having a basis weight of 50 g/m$^2$ and comprising five-layer microfibers having an average diameter less than about 10 micrometers was prepared according to the procedure of Example 1, except that a poly(ethylene terephthalate) resin (PET, having an I.V.=0.60 and a melting point of about 257° C., prepared as described in U.S. Pat. No. 4,939,008, col. 2, line 6 to col. 3, line 20) was substituted for the polypropylene and a poly(esterurethane) (PU) resin (Morthane TM PS 440-200, available from Morton Thiokol Corp.) was substituted for the Morthane TM PS 455-200 (in a 75:25 ratio), the melt streams were delivered to the five-layer feedblock at about 280° C. and about 230° C., respectively, and the feedblock, die and air temperatures were maintained at 280° C., 280° C. and 270° C., respectively.

EXAMPLE 12

A BMF web having a basis weight of 50 g/m$^2$ and comprising five-layer microfibers having an average diameter less than about 10 micrometers was prepared according to the procedure of Example 11, except that the PET and PU melt streams were delivered to the five-layer feedblock in a 50:50 ratio.

EXAMPLE 13

A BMF web having a basis weight of 50 g/m$^2$ and comprising five-layer microfibers having an average diameter less than about 10 micrometers was prepared according to the procedure of Example 11, except that the PET and PU melt streams were delivered to the five-layer feedblock in a 25:75 ratio.

CONTROL WEB V

A control web of the poly(ethylene terephthalate) (I.V.=0.60) resin was prepared according to the procedure of Example 1, except that only one extruder, which was maintained at about 300° C., was used which was connected directly to the BMF die through a gear pump, and the die and air temperatures were maintained at 300° C. and 305° C., respectively. The resulting BMF web had a basis weight of 100 g/m$^2$ and an average fiber diameter less than about 10 micrometers.

Table 4 summarizes the tensile modulus values for BMF webs comprising five-layer microfibers of varying PET/PU ratios.

TABLE 4

Tensile Modulus
Two-Layer PET/PU BMF Webs
50 g/m$^2$ Basis Weight

| Example | Pump Ratio PET/PU | MD Tensile Modulus (kPa) |
|---|---|---|
| Control V | 100:0 | 172[1] |
| 11 | 75:25 | 9674 |
| 12 | 50:50 | 10770 |
| 13 | 25:75 | 12376 |
| Control IV | 0:100 | 1834 |

[1]100 g/m$^2$ basis weight.

EXAMPLE 14

A BMF web having a basis weight of 50 g/m$^2$ and comprising five-layer microfibers having an average diameter less than about 10 micrometers was prepared according to the procedure of Example 1, except that a 60/40 blend of Kraton TM G-1657, a hydrogenated styrene/ethylene-butylene/styrene A-B-A block copolymer (SEBS) available from Shell Chemical Corp., and a linear low-density polyethylene (LLDPE) Aspun TM 6806, 105 MFR, available from Dow Chemical, was substituted for the Morthane TM PS 455-200, the extruder temperatures were maintained at 250° C. and 270° C., respectively, the melt streams were delivered to a five-layer feedblock maintained at 270° C. at a 75:25 ratio, and the die and primary air temperatures were maintained at 270° C. and 255° C., respectively.

EXAMPLE 15

A BMF web having a basis weight of 50 g/m$^2$ and comprising five-layer microfibers having an average diameter less than about 10 micrometers was prepared according to the procedure of Example 14, except that the PP and SEBS/LLDPE blend melt streams were delivered to the five-layer feedblock in a 50:50 ratio.

EXAMPLE 16

A BMF web having a basis weight of 50 g/m$^2$ and comprising five-layer microfibers having an average diameter less than about 10 micrometers was prepared according to the procedure of Example 14, except that the PP and SEBS/LLDPE blend melt streams were delivered to the five-layer feedblock in a 25:75 ratio.

CONTROL WEB VI

A control web of the 60/40 SEBS/LLDPE blend was prepared according to the procedure of Example 1, except that only one extruder, which was maintained at 270° C., was used which was connected directly to the BMF die through a gear pump, and the die and air temperatures were maintained at 270° C. The resulting BMF web had a basis weight of 50 g/m$^2$ and an average fiber diameter of less than about 10 micrometers.

Table 5 summarizes the tensile modulus values for BMF webs comprising five-layer microfibers of varying PP//SEBS/LLDPE compositions.

TABLE 5

Tensile Modulus
Five-Layer PP//SEBS/LLDPE BMF Webs
50 g/m$^2$ Basis Weight

| Example | Pump Ratio PP/Blend | MD Tensile Modulus (kPa) |
|---|---|---|
| Control I. | 100:0 | 2034 |
| 14 | 75:25 | 18685 |
| 15 | 50:50 | 12011 |
| 16 | 25:75 | 6978 |
| Control VI | 0:100 | 434 |

EXAMPLE 17

A BMF web having a basis weight of 50 g/m$^2$ and comprising two-layer microfibers having an average diameter of less than about 10 micrometers was prepared according to the procedure of Example 14, except that a two-layer feedblock assembly was substituted for the five-layer feedblock.

EXAMPLE 18

A BMF web having a basis weight of 50 g/m$^2$ and comprising two-layer microfibers having an average diameter of less than about 10 micrometers was prepared according to the procedure of Example 17, except that the PP and SEBS/LLDPE blend melt streams were delivered to the two-layer feedblock in a 50:50 ratio.

EXAMPLE 19

A BMF web having a basis weight of 50 g/m$^2$ and comprising two-layer microfibers having an average diameter of less than about 10 micrometers was prepared according to the procedure of Example 17, except that the PP and SEBS/LLDPE blend melt streams were delivered to the two-layer feedblock in a 25:75 ratio.

Table 6 summarizes the tensile modulus values for BMF webs comprising two-layer microfibers of varying PP//SEBS/LLDPE compositions.

TABLE 6

Tensile Modulus
Two-Layer PP//SEBS/LLDPE BMF Webs
50 g/m² Basis Weight

| Example | Pump Ratio PP/Blend | MD Tensile Modulus (kPa) |
|---|---|---|
| Control I | 100:0 | 2034 |
| 17 | 75:25 | 10197 |
| 18 | 50:50 | 7357 |
| 19 | 25:75 | 3103 |
| Control VI | 0:100 | 434 |

EXAMPLE 20

A BMF web having a basis weight of 100 g/m² and comprising five-layer microfibers having an average diameter of less than about 10 micrometers was prepared according to the procedure of Example 1, except that a 35 MFR polypropylene resin (PP 3085, available from Exxon Chemical Corp.) and a poly(ethyleneterephthalate) resin I.V.=0.60 were used (in a 75:25 ratio), both the PP and the PET melt streams were delivered to the five-layer feedblock at about 300° C., the die temperature was maintained at 300° C., and the air temperature maintained at 305° C.

EXAMPLE 21

A BMF web having a basis weight of 100 g/m² and comprising five-layer microfibers having an average diameter of less than about 10 micrometers was prepared according to the procedure of Example 20, except that the PP and PET melt streams were delivered to the five-layer feedblock in a 50:50 ratio.

EXAMPLE 22

A BMF web having a basis weight of 100 g/m² and comprising five-layer microfibers having an average diameter of less than about 10 micrometers was prepared according to the procedure of Example 20, except that the PP and PET melt streams were delivered to the five-layer feedblock in a 25:75 ratio.

CONTROL WEB VII

A control web of the 35 MFR polypropylene resin was prepared according to the procedure of Example 1, except that only one extruder, which was maintained at 300° C., was used which was connected directly to the BMF die through a gear pump, and the die and air temperatures were maintained at 320° C. The resulting BMF web had a basis weight of 100 g/m² and an average fiber diameter of less than about 10 micrometers.

Table 7 summarizes the tensile modulus values for BMF webs comprising five-layer microfibers of varying PP/PET compositions.

TABLE 7

Tensile Modulus
Five-Layer PP/PET BMF Webs
100 g/m² Basis Weight

| Example | Pump Ratio PP/PET | MD Tensile Modulus (kPa) |
|---|---|---|
| Control VII | 100:0 | 23179 |
| 20 | 75:25 | 12110 |
| 21 | 50:50 | 9669 |
| 22 | 25:75 | 4738 |
| Control V | 0:100 | 772 |

EXAMPLE 23

A BMF web having a basis weight of 100 g/m² and comprising two-layer microfibers having an average diameter of less than about 10 micrometers was prepared according to the procedure of Example 20, except that the PP and PET melt streams were delivered to a two-layer feedblock in a 75:25 ratio.

EXAMPLE 24

A BMF web having a basis weight of 100 g/m² and comprising three-layer microfibers having an average diameter of less than about 10 micrometers was prepared according to the procedure of Example 20, except that the PP and PET melt streams were delivered to a three-layer feedblock in a 75:25 ratio.

EXAMPLE 25

A BMF web having a basis weight of I00 g/m² and comprising two-layer microfibers having an average diameter of less than about 10 micrometers was prepared according to the procedure of Example 20, except that the PP and PET melt streams were delivered to a two-layer feedblock in a 50:50 ratio.

EXAMPLE 26

A BMF web having a basis weight of 100 g/m² and comprising three-layer microfibers having an average diameter of less than about 10 micrometers was prepared according to the procedure of Example 20, except that the PP and PET melt streams were delivered to a three-layer feedblock in a 50:50 ratio.

EXAMPLE 27

A BMF web having a basis weight of 100 g/m² and comprising two-layer microfibers having an average diameter of less than about 10 micrometers was prepared according to the procedure of Example 20, except that the PP and PET melt streams were delivered to a two-layer feedblock in a 25:75 ratio.

EXAMPLE 28

A BMF web having a basis weight of 100 g/m² and comprising three-layer microfibers having an average diameter of less than about 10 micrometers was prepared according to the procedure of Example 20, except that the PP and PET melt streams were delivered to a three-layer feedblock in a 25:75 ratio.

Table 8 summarizes the modulus for a series of PP: PET BMF webs having varying compositions and numbers of layers in the microfibers.

TABLE 8

Web Modulus as a Function of Composition and Layers
PP/PET Combinations
100 g/m² Basis Weight

| Example | Pump Ratio | Number of Layers | MD Tensile Modulus (kPa) |
|---|---|---|---|
| Control VII | 100:0 | 1 | 23179 |
| 23 | 75:25 | 2 | 16855 |
| 24 | 75;25 | 3 | 19807 |
| 20 | 75:25 | 5 | 12110 |
| 25 | 50:50 | 2 | 7228 |
| 26 | 50:50 | 3 | 13186 |
| 21 | 50:50 | 5 | 9669 |
| 27 | 25:75 | 2 | 4283 |
| 28 | 25:75 | 3 | 6448 |
| 22 | 25:75 | 5 | 4738 |

TABLE 8-continued

| Web Modulus as a Function of Composition and Layers PP/PET Combinations 100 g/m² Basis Weight | | | |
|---|---|---|---|
| Example | Pump Ratio | Number of Layers | MD Tensile Modulus (kPa) |
| Control V | 0:100 | 1 | 772 |

EXAMPLE 29

A BMF web having a basis weight of 100 g/m² and comprising five-layer microfibers having an average diameter of less than about 10 micrometers was prepared according to the procedure of Example 1, except that a 35 MFR polypropylene resin (P-3085) and a poly(4-methyl-1-pentene) resin (TPX TM, available from Mitsui as MX-007) were used, the PP and TPX TM melt streams were delivered to the five-layer feedblock at about 300° C. and about 340° C., respectively at a 75:25 ratio, and the feedblock, die and air temperatures were maintained at 340° C., 340° C. and 330° C., respectively.

EXAMPLE 30

A BMF web having a basis weight of 100 g/m² and comprising five-layer microfibers having an average diameter of less than about 10 micrometers was prepared according to the procedure of Example 29, except that the PP and TPX melt streams were delivered to the five-layer feedblock in a 50:50 ratio.

EXAMPLE 31

A BMF web having a basis weight of 100 g/m² and comprising five-layer microfibers having an average diameter of less than about 10 micrometers was prepared according to the procedure of Example 29, except that the PP and TPX melt streams were delivered to the five-layer feedblock in a 25:75 ratio.

CONTROL WEB VIII

A control web of the poly(4-methyl-1-pentene) resin was prepared according to the procedure of Example 1, except that only one extruder, which was maintained at about 340° C., was used which was connected directly to the BMF die through a gear pump, and the die and air temperatures were maintained at 340° C. and 330° C., respectively. The resulting BMF web had a basis weight of 100 g/m² and an average fiber diameter of less than about 10 micrometers.

Table 9 summarizes the tensile modulus values for BMF webs comprising five-layer microfibers of varying PP/TPX compositions.

TABLE 9

| Tensile Modulus Five-Layer PP/TPX BMF Webs 100 g/m² Basis Weight | | |
|---|---|---|
| Example | Pump Ratio PP/TPX | MD Tensile Modulus (kPa) |
| Control VII | 100:0 | 23179 |
| 29 | 75:25 | 12207 |
| 30 | 50:50 | 5159 |
| 31 | 25:75 | 4793 |
| Control VIII | 0:100 | 1883 |

EXAMPLE 32

A BMF web having a basis weight of 100 g/m² and comprising two-layer microfibers having an average diameter of less than about 10 micrometers was prepared according to the procedure of Example 29, except that the PP and TPX melt streams were delivered to a two-layer feedblock in a 75:25 ratio.

EXAMPLE 33

A BMF web having a basis weight of 100 g/m² and comprising three-layer microfibers having an average diameter of less than about 10 micrometers was prepared according to the procedure of Example 29, except that the PP and TPX melt streams were delivered to a three-layer feedblock in a 75:25 ratio.

EXAMPLE 34

A BMF web having a basis weight of 100 g/m² and comprising two-layer microfibers having an average diameter of less than about 10 micrometers was prepared according to the procedure of Example 29, except that the PP and TPX melt streams were delivered to a two-layer feedblock in a 50:50 ratio.

EXAMPLE 35

A BMF web having a basis weight of 100 g/m² and comprising three-layer microfibers having an average diameter of less than about 10 micrometers was prepared according to the procedure of Example 29, except that the PP and TPX melt streams were delivered to a three-layer feedblock in a 50:50 ratio.

EXAMPLE 36

A BMF web having a basis weight of 100 g/m² and comprising two-layer microfibers having an average diameter of less than about 10 micrometers was prepared according to the procedure of Example 29, except that the PP and TPX melt streams were delivered to a two-layer feedblock in a 25:75 ratio.

EXAMPLE 37

A BMF web having a basis weight of 100 g/m² and comprising three-layer microfibers having an average diameter of less than about 10 micrometers was prepared according to the procedure of Example 29, except that the PP and TPX melt streams were delivered to a three-layer feedblock in a 25:75 ratio.

Table 10 summarizes the modulus for a series of PP/TPX BMF webs having varying compositions and numbers of layers in the microfibers.

TABLE 10

| Web Modulus as a Function of Composition and Layers PP/TPX Combinations | | | |
|---|---|---|---|
| Example | Pump Ratio | Number of Layers | MD Tensile Modulus (kPa) |
| Control VII | 100:0 | 1 | 23179 |
| 32 | 75;25 | 2 | 14945 |
| 33 | 75:25 | 3 | 14014 |
| 29 | 75:25 | 5 | 12207 |
| 34 | 50:50 | 2 | 6655 |
| 35 | 50:50 | 3 | 6186 |
| 30 | 50:50 | 5 | 5159 |
| 36 | 25:75 | 2 | 3897 |
| 37 | 25:75 | 3 | 4145 |
| 31 | 25:75 | 5 | 4793 |
| Control VIII | 0:100 | 1 | 1883 |

EXAMPLE 38

A BMF web having a basis weight of 100 g/m$^2$ and comprising two-layer microfibers having an average diameter of less than about 10 micrometers was prepared according to the procedure of Example 8, except that the collector distance was 15.2 cm (6 in.).

EXAMPLE 39

A BMF web having a basis weight of 100 g/m$^2$ and comprising two-layer microfibers having an average diameter of less than about 10 micrometers was prepared according to the procedure of Example 9, except that the collector distance was 15.2 cm (6 in.).

EXAMPLE 40

A BMF web having a basis weight of 100 g/m$^2$ and comprising two-layer microfibers having an average diameter of less than about 10 micrometers was prepared according to the procedure of Example 10, except that the collector distance was 15.2 cm (6 in.).

Table 11 summarizes the MD modulus values for a number of two-layer PE/PU web compositions which were prepared utilizing two collector distances.

TABLE 11

Web Modulus as a Function of Collector Distance for Various Two-Layer PE/PU Compositions 100 g/m$^2$ Basis Weight

| Example | Pump Ratio PE/PU | Collector Distance (cm) | MD Tensile Modulus (kPa) |
|---|---|---|---|
| 8 | 75:25 | 30.5 | 4923 |
| 38 | 75:25 | 15.2 | 12590 |
| 9 | 50:50 | 30.5 | 3737 |
| 39 | 50:50 | 15.2 | 9494 |
| 10 | 25:75 | 30.5 | 2654 |
| 40 | 25:25 | 15.2 | 7929 |

EXAMPLE 41

A BMF web having a basis weight of 100 g/m$^2$ and comprising twenty-seven-layer microfibers having an average diameter of less than about 10 micrometers was prepared according to the procedure of Example 7, except that the PP and PU melt streams were delivered to the twenty-seven-layer feedblock such that the outer layer of the fibers was PU rather than PP (I/O vs O/I for Example 7) and the die orifices had a diameter of 17/1000 in versus 15/1000 in for Example 7.

Table 12 summarizes the MD modulus for two twenty-seven-layer layer PP/PU microfiber webs where the order of polymer feed into the feedblock was reversed, thereby inverting the composition of the outer layer of the microfiber.

TABLE 12

Effect of Outside Component Twenty-Seven-Layer 25:75 PP/PU Composition 100 g/m$^2$ Basis Weight

| Example | Layer Composition | MD Tensile Modulus (kPa) |
|---|---|---|
| 41a | O/I | 14390 |
| 41 | I/O | 11632 |

EXAMPLE 42

A BMF web having a basis weight of 50 g/m$^2$ and comprising five-layer microfibers having an average diameter of less than about 10 micrometers was prepared according to the procedure of Example 20, except that the collector distance was 27.9 cm.

EXAMPLE 43

A BMF web having a basis weight of 50 g/m$^2$ and comprising five-layer microfibers having an average diameter of less than about 10 micrometers was prepared according to the procedure of Example 42, except that the PP and PET melt streams were delivered to the five-layer feedblock such that the outer layer of the fibers was PET rather than PP (O/I vs I/O for Example 42).

Figure 4:
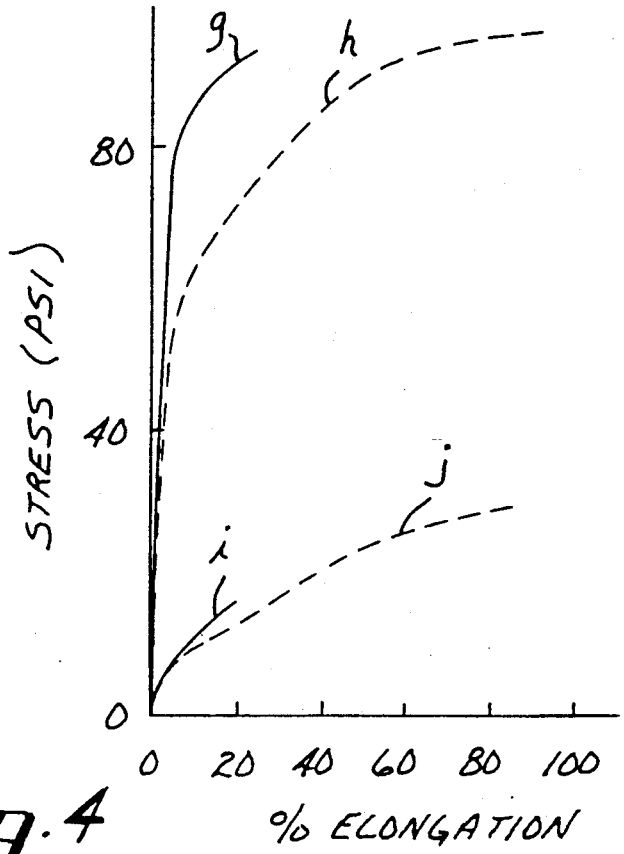
FIG. 4 is a plot of stress/strain data showing the effect of the choice of outside layer material.

Table 13 summarizes the MD peak load and peak stress for two five-layer PP/PET microfiber webs where the order of polymer feed into the feedblock was reversed, thereby inverting the composition of the outer layer of the microfiber. This is also shown in FIG. 4 (in PSI) where g and h correspond to Example 42 elongated in the machine and cross direction respectively and i and j correspond to Example 43 elongated in the machine and cross direction respectively.

TABLE 13

Effect of Outside Component Five-Layer 75:25 PP/PET Composition 50 g/m$^2$ Basis Weight

| Example | Layer Composition | MD Peak Load (kg) | MD Peak Stress (kPa) |
|---|---|---|---|
| 42 | O/I | 2.1 | 593 |
| 43 | I/O | 0.4 | 124 |

EXAMPLE 44

A BMF web having a basis weight of 100 g/m$^2$ and comprising twenty-seven-layer microfibers having an average diameter of less than about 10 micrometers was prepared according to the procedure of Example 7, except that the PP and PU melt streams were delivered to the twenty-seven-layer feedblock which was maintained at 250° C. in a 75:25 ratio from two extruders which were maintained at 250° C. and 210° C., respectively, and a smooth collector drum was positioned 15.2 cm from the BMF die. The PP and PU melt streams were introduced into the feedblock assembly such that the outer layer of the fiber was PP (O/I).

EXAMPLE 45

A BMF web having a basis weight of 100 g/m$^2$ and comprising twenty-seven-layer microfibers having an average diameter of less than about 10 micrometers was prepared according to the procedure of Example 44, except that the PP and PU melt streams were delivered to the twenty-seven-layer feedblock in a 50:50 ratio.

EXAMPLE 46

A BMF web having a basis weight of 100 g/m$^2$ and comprising twenty-seven-layer microfibers having an average diameter of less than about 10 micrometers was prepared according to the procedure of Example 44, except that the PP and PU melt streams were delivered to the twenty-seven-layer feedblock in a 25:75 ratio.

EXAMPLE 47

Figure 5:
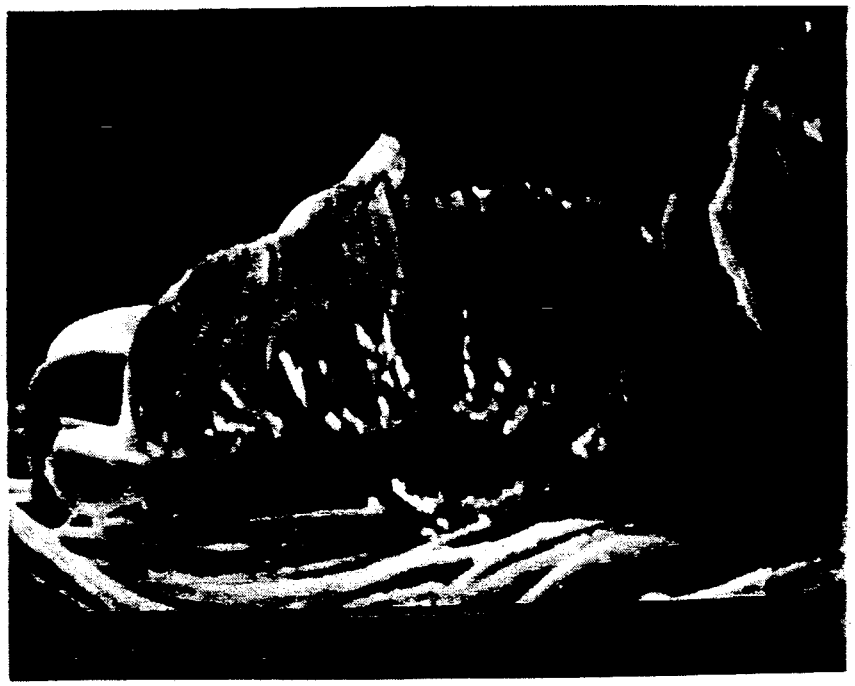

A BMF web having a basis weight of 100 g/m$^2$ and comprising twenty-seven-layer microfibers having an average diameter of less than about 10 micrometers was prepared according to the procedure of Example 44, except that a LLDPE (Aspun TM 6806, 105 MI, available from Dow Chemical) was substituted for the PP and the PE and PU melt streams were delivered to the twenty-seven-layer feedblock which was maintained at 210° C. in a 75:25 ratio from two extruders which were both maintained at 210° C. A scanning electron micrograph (FIG. 5-2000X) of a cross section of this sample was prepared. The polyurethane was washed out with tetrahydrofuran and the sample was then cut, mounted and prepared for analysis by standard techniques.

EXAMPLE 48

A BMF web having a basis weight of 100 g/m$^2$ and comprising twenty-seven-layer microfibers having an average diameter of less than about 10 micrometers was prepared according to the procedure of Example 47, except that the PE and PU melt streams were delivered to the twenty-seven-layer feedblock in a 50:50 ratio.

EXAMPLE 49

A BMF web having a basis weight of 100 g/m$^2$ and comprising twenty-seven-layer microfibers having an average diameter of less than about 10 micrometers was prepared according to the procedure of Example 47, except that the PE and PU melt streams were delivered to the twenty-seven-layer feedblock in a 25:75 ratio.

Table 14 summarizes the MD tensile modulus for several twenty-seven-layer microfiber webs where the composition of the outer layer of the fiber varied between PP and PE.

TABLE 14

Effect of PP vs. PE on MD Web Tensile Modulus
27 Layer PP/PU and PE/PU Webs
100 g/m$^2$ Basis Weight

| Example | Web Composition: Polymers | Web Composition: Pump Ratio | MD Tensile Modulus (kPa) |
|---|---|---|---|
| 44 | PP/PU | 75:25 | 95940 |
| 45 | PP/PU | 50:50 | 46396 |
| 46 | PP/PU | 25:75 | 28090 |
| 47 | PE/PU | 75:25 | 19926 |
| 48 | PE/PU | 50:50 | 12328 |
| 49 | PE/PU | 25:75 | 7819 |

EXAMPLES 50–70

Multi-layered BMF webs were prepared according to the procedure of Example 1, except for the indicated fiber-forming thermoplastic resin substitutions, the corresponding changes in extrusion temperatures, fiber composition ratios, BMF web basis weights, and BMF die/collector distances, as detailed in Table 25. The BMF webs were prepared to demonstrate the breadth of the instant invention and were not characterized in the detail of the webs of prior examples.

EXAMPLE 71

Figure 6:
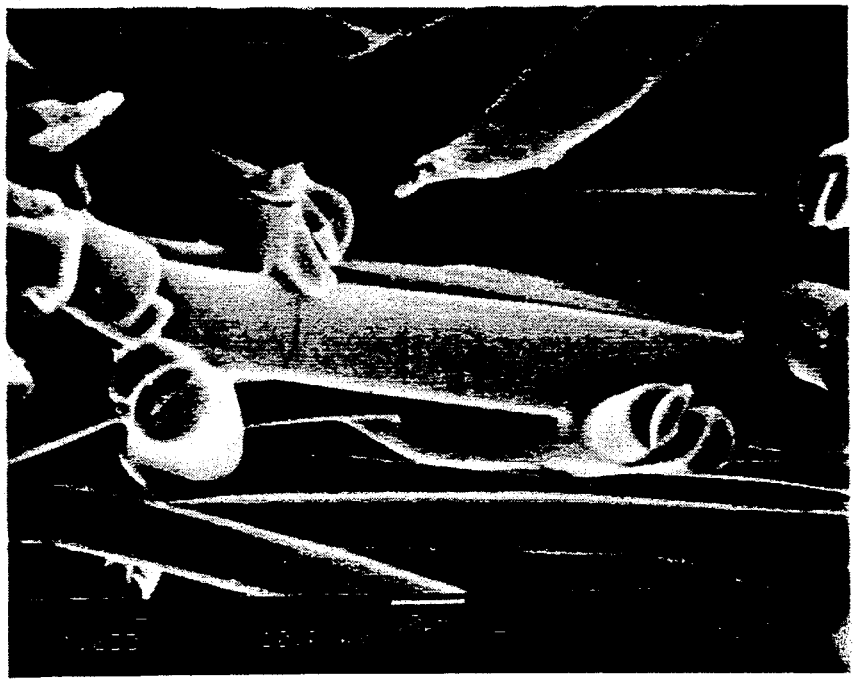
FIGS. 5 and 6 are scanning electron micrographs of web cross sections, for Examples 47 and 71, respectively, prepared by the invention method.

A BMF web was prepared according to the procedure of Example 8 except that the PE and PU melt streams were delivered to a three-layer feedblock. The samples were prepared for SEM analysis as per Example 47 except the PU was not removed, FIG. 6(1000x).

The various modifications and alterations of this invention will be apparent to those skilled in the art without departing from the scope and spirit of this invention and this invention should not be restricted to that set for herein for illustrative purposes.

TABLE 25

MULTI-LAYER BMF WEB COMPOSITIONS

| Example | BMF Fiber Composition (Pump Ratio) | # Layers | Extruder Temp. (°C.) | Feed Block Temp. (°C.) | Web Basis Weight (gm/m$^2$) | Collector/ Die Distance (cm) |
|---|---|---|---|---|---|---|
| 50 | PP[1]/PE[2](75/25) | 5 | 300/230 | 300 | 75 | 12 |
| 51 | PP[1]/PE[2](50/50) | 5 | 300/230 | 300 | 75 | 12 |
| 52 | PP[1]/PE[2](25/75) | 5 | 300/230 | 300 | 75 | 12 |
| 53 | PP[1]/PE[3](25/75) | 5 | 300/230 | 300 | 75 | 10 |
| 54 | PP[4]/PBT[5](50/50) | 5 | 260/240 | 260 | 75 | 20[a] |
| 55 | PP[4]/PCT[6](50/50) | 5 | 260/310 | 310 | 75 | 12 |
| 56 | PP[4]/Nylon6[7](50/50) | 5 | 260/320 | 320 | 75 | 12 |
| 57 | PP[1]/Polycarbonate[8](87.5/12.5) | 5 | 310/300 | 300 | 55 | 10 |
| 58 | PP[9]/Polystyrene[10](87.5/12.5) | 5 | 250/270 | 270 | 55 | 9 |
| 59 | PP[9]/PE[11](75/25) | 5 | 230/210 | 230 | 100 | 13 |
| 60 | PP[9]/Kraton[13](25/75) | 5 | 260/260 | 260 | 90 | 13 |
| 61 | PP[9]/PVA Copoly.[14](50/50) | 5 | 240/200 | 240 | 110 | 10 |
| 62 | PU[15]/PVA Copoly.[14](50/50) | 27 | 200/200 | 200 | 150 | 10 |
| 63 | PE[16]/PU[15](75/25) | 27 | 210/210 | 210 | 100 | 12 |
| 64 | PE[16]/PU[15](50/50) | 27 | 210/210 | 210 | 100 | 12 |
| 65 | PE[16]/PU[15](25/75) | 27 | 210/210 | 210 | 100 | 12 |
| 66 | PE[16]/Kraton[13](50/50) | 27 | 210/270 | 250 | 100 | 12 |
| 67 | PE[16]/Kraton[13](25/75) | 27 | 210/270 | 250 | 100 | 12 |
| 68 | PET[17]/Polycarbonate[8](50/50) | 5 | 290/300 | 300 | 75 | 20a |
| 69 | PBT[5]/Polycarbonate[8](50/50) | 5 | 250/300 | 300 | 75 | 12 |

TABLE 25-continued

MULTI-LAYER BMF WEB COMPOSITIONS

| Example | BMF Fiber Composition (Pump Ratio) | # Layers | Extruder Temp. (°C.) | Feed Block Temp. (°C.) | Web Basis Weight (gm/m$^2$) | Collector/ Die Distance (cm) |
|---|---|---|---|---|---|---|
| 70 | PET[17]/Nylon6[7](50/50) | 5 | 290/310 | 310 | 80 | 12 |

[1]PP 3085, available from Exxon Chemical Corp., 35 MFR
[2]Aspun 6805, LLDPE from Dow Chemical, 50 MFR
[3]Aspun 6805 containing 20% wetting agent concentrate using 105 MFR LLDPE as a carrier, available from Dow Chemical.
[4]PP 3145, available from Exxon Chemical Corp., 300 MFR
[5]PBT, available from Hoechst Celanese Corp.
[6]PCT 3879, available from Eastman Kodak Co.
[7]Nylon 6, available from Monsanto
[8]10 MFR polycarbonate available from Dow Chemical Corp.
[9]PP 3495G, available from Exxon Chemical Corp., 800 MFR
[10]XPR-00642-D-0004-16, available from Dow Chemical Corp.
[11]Aspun 6806, 105 MFR LLDPE with 0.5% Pluronic L-64.
[12]PP 3505, available from Exxon Chemical Corp., 400 MFR
[13]Kraton G-1657, available from Shell Chemical Corp.
[14]Vinex PVA copolymer, available from Air Products Corp.
[15]PU-455-200, available from Morton Thiokol Corp.
[16]Aspun 6806, 105 MFR LLDPE available from Dow Chemical Corp.
[17]Internal preparation, I.V. = 0.65
[a]Used orienting chamber as described in U.S. Pat. No. 4,988,560.

We claim:

1. A method for forming a nonwoven web of melt-blown microfibers comprising the steps of a) providing at least two streams of flowable polymeric materials b) dividing at least one stream of the at least two streams into two or more separate streams, c) combining said at least two streams, with at least one stream divided into said separate streams, as layers in a layered, combined rectilinear flowstream, the layers being parallel each to the other, d) forming the combined rectilinear flowstream in a laminar manner into a flowstream having an overall height of about 50 mils or less while maintaining the parallel layers, e) extruding the combined rectilinear flowstream through a die containing multiple side-by-side orifices to form a plurality of side-by-side flowstreams, f) attenuating the extruded side-by-side flowstreams with two high-velocity gaseous streams located at each side of the die face to form microfibers, and g) collecting the microfibers on a collecting surface as an entangled melt-blown web formed of melt-blown microfibers having at least three continuous layers.

2. The method of claim 1 wherein the separate streams are combined to provide alternating parallel layers of the at least two streams of flowable polymeric materials in the combined flowstream.

3. The method of claim 1 wherein there are at least five divided streams of two flowable polymeric materials combined to provide alternating parallel layers in the combined flowstream.

4. The method of claim 1 wherein the melt-blown microfibers in the web average no more than about 10 micrometers in diameter.

5. The method of claim 1 wherein the formed rectilinear flowstream has an overall height of about 30 mils or less.

* * * * *

UNITED STATES PATENT AND TRADEMARK OFFICE

CERTIFICATE OF CORRECTION

PATENT NO. : 5,207,970

DATED : May 4, 1993

INVENTOR(S) : Eugene G. Joseph and Daniel E. Meyer

It is certified that error appears in the above-identified patent and that said Letters Patent is hereby corrected as shown below:

Column 3, line 40, delete "parts" and insert --ports--.

Column 13, line 34, delete "Two-Layer" in TABLE 4 heading and insert --Five-Layer--.

Column 13, line 39, delete "172'" and insert --772'--.

Signed and Sealed this

Eighth Day of February, 1994

Bruce Lehman

BRUCE LEHMAN

*Commissioner of Patents and Trademarks*

*Attest:*

*Attesting Officer*